US010102809B2

(12) United States Patent
Oya

(10) Patent No.: US 10,102,809 B2
(45) Date of Patent: Oct. 16, 2018

(54) IMAGE DISPLAY APPARATUS AND CONTROL METHOD THEREOF

(71) Applicant: CANON KABUSHIKI KAISHA, Tokyo (JP)

(72) Inventor: Tsuyoshi Oya, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 15/203,356

(22) Filed: Jul. 6, 2016

(65) Prior Publication Data

US 2017/0011690 A1 Jan. 12, 2017

(30) Foreign Application Priority Data

Jul. 8, 2015 (JP) ..... 2015-136943

(51) Int. Cl.
*G09G 3/34* (2006.01)
*G09G 3/36* (2006.01)

(52) U.S. Cl.
CPC ..... *G09G 3/3406* (2013.01); *G09G 3/342* (2013.01); *G09G 3/3413* (2013.01); *G09G 3/3426* (2013.01); *G09G 3/36* (2013.01); *G09G 2320/0233* (2013.01); *G09G 2320/0238* (2013.01); *G09G 2320/0271* (2013.01); *G09G 2320/0276* (2013.01); *G09G 2320/066* (2013.01); *G09G 2320/0646* (2013.01); *G09G 2320/0653* (2013.01);
(Continued)

(58) Field of Classification Search
CPC ..... G09G 3/342; G09G 2320/0626; G09G 3/3406; G09G 2300/023; G06K 9/4661
See application file for complete search history.

(56) References Cited

U.S. PATENT DOCUMENTS

2007/0024558 A1 2/2007 Oura
2012/0223977 A1* 9/2012 Inada ..... G09G 3/3611 345/690
(Continued)

FOREIGN PATENT DOCUMENTS

EP 2899688 A1 7/2015
JP 10-084551 A 3/1998
(Continued)

OTHER PUBLICATIONS

The above patent documents were cited in a Nov. 17, 2016 European Search Report, which is enclosed, that issued in European Patent Application No. 16178143.0.

*Primary Examiner* — Yuzhen Shen
(74) *Attorney, Agent, or Firm* — Cowan, Liebowitz & Latman, P.C.

(57) ABSTRACT

An image display apparatus, includes: a first conversion unit configured to generate first image data by applying a first gradation conversion characteristic to input image data; a light-emitting unit; a control unit configured to control an emission brightness of the light-emitting unit; a second conversion unit configured to generate second image data by correcting gradation values of the first image data based on the emission brightness of the light-emitting unit; a third conversion unit configured to generate third image data by applying a second gradation conversion characteristic to the second image data; and a display unit configured to display an image by transmitting light emitted from the light-emitting unit based on the third image data.

13 Claims, 12 Drawing Sheets

(52) U.S. Cl.
CPC . *G09G 2320/0673* (2013.01); *G09G 2320/08* (2013.01); *G09G 2360/16* (2013.01)

(56) References Cited

U.S. PATENT DOCUMENTS

2015/0228215 A1* 8/2015 Nose ..... G06T 11/001
345/590
2015/0242701 A1* 8/2015 Tokui ..... H04N 5/243
382/190

FOREIGN PATENT DOCUMENTS

JP 2002-099250 A 4/2002
WO 2014045915 A1 3/2014

* cited by examiner

DISPLAY GRADATION VALUE
1024
768
512
256
128
0
0
256
512
768
1024
INPUT GRADATION VALUE

TRANSMITTANCE GRADATION VALUE
1024
768
512
360
220
174
128
0
0
128
256
512
768
1024
DISPLAY GRADATION VALUE
BL BRIGHTNESS=1.0
BL BRIGHTNESS=0.5
BL BRIGHTNESS=0.3
BL BRIGHTNESS=0.1

PANEL GRADATION VALUE
1024
768
512
340
184
123
0
0
128
174
220
360
512
768
1024
TRANSMITTANCE GRADATION VALUE

DISPLAY GRADATION VALUE
1024
768
512
256
78
0
0
256
512
768
1024
INPUT GRADATION VALUE

TRANSMITTANCE GRADATION VALUE
1024
768
512
219
134
106
78
0
0
78
256
512
768
1024
DISPLAY GRADATION VALUE
BL BRIGHTNESS=1.0
BL BRIGHTNESS=0.5
BL BRIGHTNESS=0.3
BL BRIGHTNESS=0.1

PANEL GRADATION VALUE
1024
768
512
340
183
42
0
0
78
134
106
219
512
768
1024
TRANSMITTANCE GRADATION VALUE

IMAGE DISPLAY APPARATUS AND CONTROL METHOD THEREOF

BACKGROUND OF THE INVENTION

Field of the Invention

The present invention relates to an image display apparatus and a control method thereof.

Description of the Related Art

A liquid crystal display has a liquid crystal panel and a backlight unit. The liquid crystal panel has a plurality of liquid crystal elements. The transmittance of each liquid crystal element is controlled by controlling the voltage applied to each liquid crystal element. The voltage applied to each liquid crystal element is determined in accordance with gradation values of liquid crystal elements input to the liquid crystal panel. The backlight unit is provided on the backside of the liquid crystal panel. Light from the backlight unit is modulated as it passes through each liquid crystal element. An image is displayed on the screen by the modulated light (light that has passed through each liquid crystal element).

Sometimes, however, the orientation of liquid crystal molecules in the liquid crystal element may be disturbed for various reasons. Such disturbed orientation of liquid crystal molecules may sometimes lead to unevenness in the transmittance of the liquid crystal panel. For example, the liquid crystal panel maybe subjected to stress via a support member that supports the liquid crystal panel. Such stress applied to the liquid crystal panel may cause a disturbance in the orientation of the liquid crystal molecules, unevenness in the transmittance, and the like. Unevenness in the transmittance appears as non-uniformity (unevenness) in brightness or chromaticity (visual non-uniformity) and hinders visual perception of an image. The intensity of such visual non-uniformity is dependent on the voltage applied to each liquid crystal element. For example, visual non-uniformity occurs to a greater degree in a case where the voltage applied to each liquid crystal element is low. The visual non-uniformity is particularly pronounced in a case where a black image (entirely black image) is displayed in an IPS normally black mode. Such visual non-uniformity will be hereinafter referred to as "black non-uniformity".

Shapes and sizes of patches that cause black non-uniformity are not uniform and change because of various factors. Black non-uniformity may vary because of the impact applied to the liquid crystal display, for example, or may vary due to changes in the ambient conditions such as temperature. Therefore, an image processing method that is based on the measurement results of the status of black non-uniformity at a certain time point may not be effective in reducing the black non-uniformity.

As a method of reducing black non-uniformity caused by various factors, a method whereby voltage applied to liquid crystal elements is increased, i.e., the gradation value input to the liquid crystal panel is increased, has been proposed (Japanese Patent Application Laid-open No. H10-84551).

Also, various methods called local dimming have been proposed as a method of enhancing the contrast of an image displayed on a liquid crystal display (displayed image). For example, a technique relating to local dimming is disclosed in Japanese Patent Application Laid-open No. 2002-99250. In the technique disclosed in Japanese Patent Application Laid-open No. 2002-99250, a plurality of light sources are used as the light source of the backlight unit. The emission brightness of the plurality of light sources is controlled individually based on the brightness of the image data, and the image data is corrected based on the emission brightness of each light source. The contrast of the displayed image can be enhanced with the use of such a technique.

SUMMARY OF THE INVENTION

With the use of the technique disclosed in Japanese Patent Application Laid-open No. H10-84551, black non-uniformity can be reduced. However, since the display brightness (brightness on the screen) of black is increased by raising the voltage applied to each liquid crystal element, the contrast of the displayed image is reduced. With the use of the technique disclosed in Japanese Patent Application laid-open No. 2002-99250, while the contrast of the displayed image can be enhanced, black non-uniformity is not reduced.

The present invention provides a technique that enables reduction of black non-uniformity while maintaining the contrast of a displayed image.

The present invention in its first aspect provides an image display apparatus comprising:

a first conversion unit configured to generate first image data by applying, to input image data, a first gradation conversion characteristic that increases a lower limit of input gradation values to a first gradation value and converts input gradation values to corresponding output gradation values;

a light-emitting unit;

a control unit configured to control an emission brightness of the light-emitting unit based on the input image data or the first image data;

a second conversion unit configured to generate second image data by correcting gradation values of the first image data based on the emission brightness of the light-emitting unit;

a third conversion unit configured to generate third image data by applying, to the second image data, a second gradation conversion characteristic that reduces input gradation values equal to or lower than a second gradation value to a predetermined value and converts input gradation values to a corresponding output gradation values; and a display unit configured to display an image by transmitting light emitted from the light-emitting unit based on the third image data.

The present invention in its second aspect provides a control method for an image display apparatus including a light-emitting unit and a display unit, wherein the display unit displays an image by transmitting light emitted from the light-emitting unit based on image data input to the display unit, and the control method includes:

a first conversion step of generating first image data by applying, to input image data, a first gradation conversion characteristic that increases a lower limit of input gradation values to a first gradation value and converts input gradation values to corresponding output gradation values;

a control step of controlling an emission brightness of the light-emitting unit based on the input image data or the first image data;

a second conversion step of generating second image data by correcting gradation values of the first image data based on the emission brightness of the light-emitting unit; and a third conversion step of generating third image data by applying, to the second image data, a second gradation conversion characteristic that reduces input gradation values equal to or lower than a second gradation value to a predetermined value and converts input gradation values to corresponding output gradation values, and outputting the third image data to the display unit.

The present invention in its third aspect provides a non-transitory computer readable medium that stores a program, wherein the program causes a computer to execute a control method for an image display apparatus including a light-emitting unit and a display unit, the display unit displays an image by transmitting light emitted from the light-emitting unit based on image data input to the display unit, and the control method includes:

a first conversion step of generating first image data by applying, to input image data, a first gradation conversion characteristic that increases a lower limit of input gradation values to a first gradation value and converts input gradation values to corresponding output gradation values;

a control step of controlling an emission brightness of the light-emitting unit based on the input image data or the first image data;

a second conversion step of generating second image data by correcting gradation values of the first image data based on the emission brightness of the light-emitting unit; and a third conversion step of generating third image data by applying, to the second image data, a second gradation conversion characteristic that reduces input gradation values equal to or lower than a second gradation value to a predetermined value and converts input gradation values to corresponding output gradation values, and outputting the third image data to the display unit.

According to the present invention, black non-uniformity can be reduced while the contrast of a displayed image is maintained.

Further features of the present invention will become apparent from the following description of exemplary embodiments with reference to the attached drawings.

DESCRIPTION OF THE EMBODIMENTS

Hereinafter, an image display apparatus and a control method thereof according to an embodiment of the present invention will be described. While the image display apparatus will be described as a transmissive liquid crystal display as one example in this embodiment, the image display apparatus is not limited to transmissive liquid crystal displays. The image display apparatus may be any display device as long as it includes a light-emitting unit, and a display panel that displays an image on a screen by modulating the light from the light-emitting unit based on image data. The image display apparatus may be a reflective liquid crystal display, for example. Or, the image display apparatus may be a micro electromechanical system (MEMS) shutter display that uses MEMS shutters instead of liquid crystal elements.

Figure 1:
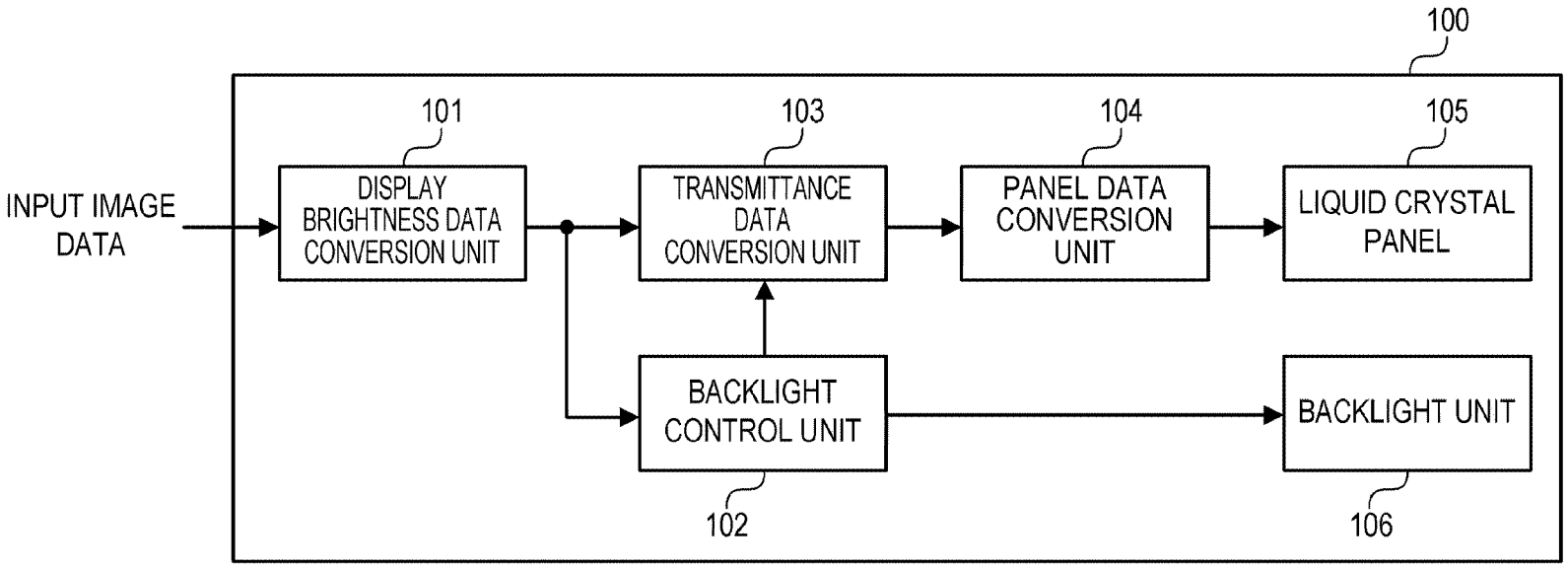
FIG. 1 is a block diagram illustrating an example of the functional configuration of an image display apparatus according to one embodiment.

FIG. 1 is a block diagram illustrating one example of the functional configuration of an image display apparatus 100 according to this embodiment. As shown in FIG. 1, the image display apparatus 100 includes a display brightness data conversion unit 101, a backlight control unit 102, a transmittance data conversion unit 103, a panel data conversion unit 104, a liquid crystal panel 105, and a backlight unit 106.

The liquid crystal panel 105 is a display panel that has a plurality of liquid crystal elements. Voltage is applied to each of the liquid crystal elements in accordance with gradation values input to the liquid crystal panel 105. The transmittance of each liquid crystal element changes in accordance with the applied voltage. In this embodiment, the gradation values input to the liquid crystal panel 105 will be referred to as "panel gradation values", while the data (image data) including respective panel gradation values of liquid crystal elements will be referred to as "panel data".

The backlight unit 106 is a light-emitting unit that projects light to the backside of the liquid crystal panel 105. The backlight unit 106 includes one or more light sources. The light source includes one or more light-emitting elements. Light-emitting diodes, organic EL elements, cold-cathode tubes and the like may be used as the light-emitting elements. In this embodiment, the backlight unit 106 has a plurality of light sources respectively corresponding to a plurality of regions within a screen, and the emission brightness of the plurality of light sources is controlled individually. Voltage is applied to each of the light sources in accordance with the gradation values input to the backlight unit 106. The emission brightness of each light source changes in accordance with the applied voltage. In this embodiment, the gradation values input to the backlight unit 106 will be referred to as "BL control values", while the data including respective BL control values of the light sources will be referred to as "BL control data".

Light from the backlight unit 106 is modulated as it passes through each liquid crystal element. An image is displayed on the screen by the modulated light (light that has passed through each liquid crystal element).

The display brightness data conversion unit 101 acquires data of an input image (image data input to the image display apparatus 100), converts the input image data into display brightness data (first converted image data), and outputs the display brightness data. In this embodiment, the display brightness data conversion unit 101 determines a first correspondence based on a contrast ratio (monitor contrast ratio) and a gamma value (monitor gamma value) related to display characteristics of the image display apparatus 100. The monitor contrast ratio is a target value of the contrast ratio of display brightness (upper limit of display brightness : lower limit of display brightness). The display brightness is the brightness on the screen. The first correspondence is a correspondence relation between an input gradation value, which is a gradation value of input image data, and a display gradation value, which is a gradation value corresponding to the display brightness. The display brightness data conversion unit 101 converts the input gradation values (the gradation values contained in the input image data) into display gradation values based on the determined first correspondence, so as to generate display brightness data wherein each gradation value is a display gradation value. The display brightness corresponding to the display gradation value is the optimal display brightness determined in consideration of the display characteristics of the image display apparatus 100.

The first correspondence may be a fixed relation predetermined by the manufacturer. At least one of the monitor contrast ratio and the monitor gamma value may be a fixed value predetermined by the manufacturer.

The display brightness dealt with in the image display apparatus 100 is not defined to be a specific value. In this embodiment, "1" is used as the display brightness value corresponding to the upper limit of the input gradation value. The display brightness values used here are values relative to the display brightness value corresponding to the upper limit of the input gradation value. Display gradation values correspond to the thus defined display brightness values. In this embodiment, the display brightness data conversion unit 101 generates image data through gamma correction with a transmitted gamma value as the display brightness data, in order to maintain the gradation quality (gradation precision) of input image data with a limited number of bits.

In this embodiment, a display mode, which corresponds to the monitor contrast ratio and the monitor gamma value, is set for the image display apparatus 100. The monitor contrast ratio and the monitor gamma value may be set simultaneously, or individually. For example, a monitor gamma value of 2.2, or 2.6, etc. is set. The display brightness data conversion unit 101 generates display brightness data based on the set display mode and transmitted gamma value.

The display brightness data conversion unit 101 converts the input gradation values into display brightness values, using the following equation 1. Equation 1 uses Cm:1 as the monitor contrast ratio, with a bit depth of for the input gradation value. In Equation 1, $\gamma i$ represents the monitor gamma value, Si represents the input gradation value, and lum represents the display brightness value. The bit depth of the input gradation value may be larger or smaller than 10.

$$\text{lum}=(1+(Cm-1)\times(Si/1023)^{\gamma i})/Cm \quad \text{(Equation 1)}$$

The display brightness data conversion unit 101 converts the display brightness values calculated by Equation 1 into display gradation values by gamma correction using a transmitted gamma value. This way, display brightness data is generated. More specifically, display brightness values are converted into display gradation values using the following equation 2. Equation 2 is an equation in a case where the bit depth of display gradation value is 10. In Equation 2, $\gamma t$ represents the transmitted gamma value, and L represents the display gradation value. The bit depth of the display gradation value may be larger or smaller than 10.

$$L=lum^{\gamma t}\times 1023 \quad \text{(Equation 2)}$$

Figure 2:
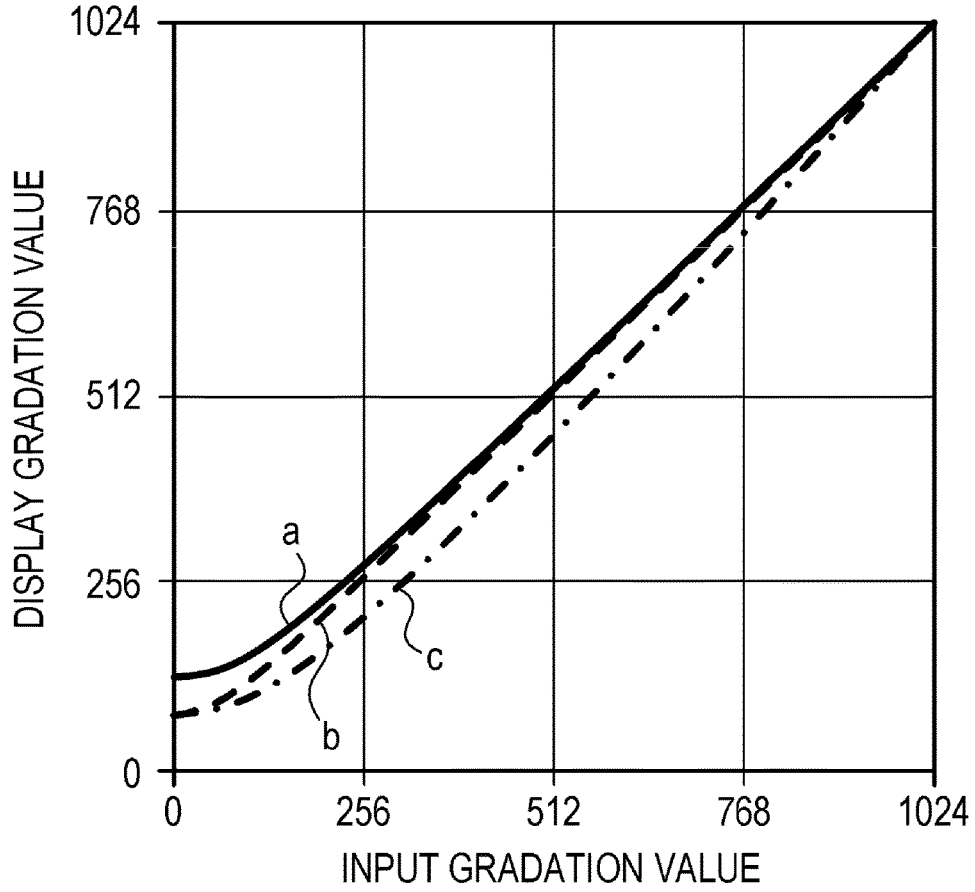
FIG. 2 is a chart showing an example of a first correspondence according to the embodiment.

FIG. 2 shows an example of a correspondence relation (first correspondence) between the input gradation value and the display gradation value. FIG. 2 shows a correspondence in a case where $\gamma t=0.45$. The solid line a in FIG. 2 shows a correspondence in a case where $\gamma i=2.2$ and Cm=100, the broken line b shows a correspondence in a case where $\gamma i=2.2$ and Cm=300, and the one-dot-chain line c shows a correspondence in a case where $\gamma i=2.6$ and Cm=300. The first correspondence is not limited to a particular one. In this embodiment, as shown in FIG. 2, a correspondence relation in which the display gradation value increases non-linearly with the increase in the input gradation value is used as the first correspondence. This is because a monitor gamma value and a transmitted gamma value were used. The input gradation value can be converted into the display gradation value more accurately by using a monitor contrast ratio, monitor gamma value, and transmitted gamma value. Also, in this embodiment, as shown in FIG. 2, the lower limit of the display gradation value in the first correspondence is larger than the lower limit of the gradation value of the input image data.

The method of conversion into display gradation values is not limited to the one described above. A correspondence relation in which the display gradation value increases linearly with the increase in the input gradation value may be used as the first correspondence. Methods whereby input gradation values are converted into display gradation values with the use of a look up table (LUT) that outputs a display gradation value corresponding to an input gradation value are more preferable in terms of processing load than methods whereby input gradation values are converted into display gradation values through calculation using mathematical equations. Such an LUT can be generated in advance by calculating display gradation values each corresponding to input gradation values in advance. Alternatively, the monitor contrast ratio and monitor gamma value may be set through an input of specific values by a user to the image display apparatus 100, or they may be set otherwise. For example, a standard such as BT.1886 may be selected by the user, so that the input gradation value is converted into a display brightness value with the use of a conversion equation in accordance with the selected standard.

The backlight control unit 102 acquires the display brightness data output from the display brightness data conversion unit 101, and controls the emission brightness of the backlight unit 106 based on the display brightness data. More specifically, the backlight control unit 102 acquires the display brightness data output from the display brightness data conversion unit 101, generates BL control data and BL brightness data based on the display brightness data, and outputs the BL control data and BL brightness data.

In this embodiment, the BL control data is generated such that the emission brightness of the plurality of light sources in the backlight unit 106 is controlled individually. More specifically, the BL control data is generated such that the emission brightness of a light source for a screen region where a bright part of an image is displayed (screen region) is controlled to be a high value, and the emission brightness of a light source for a screen region where a dark part of the image is displayed is controlled to be a low value. The BL control data is transmitted to the backlight unit 106 so that the emission brightness of the backlight unit 106 is controlled in accordance with the BL control data.

Figure 3:
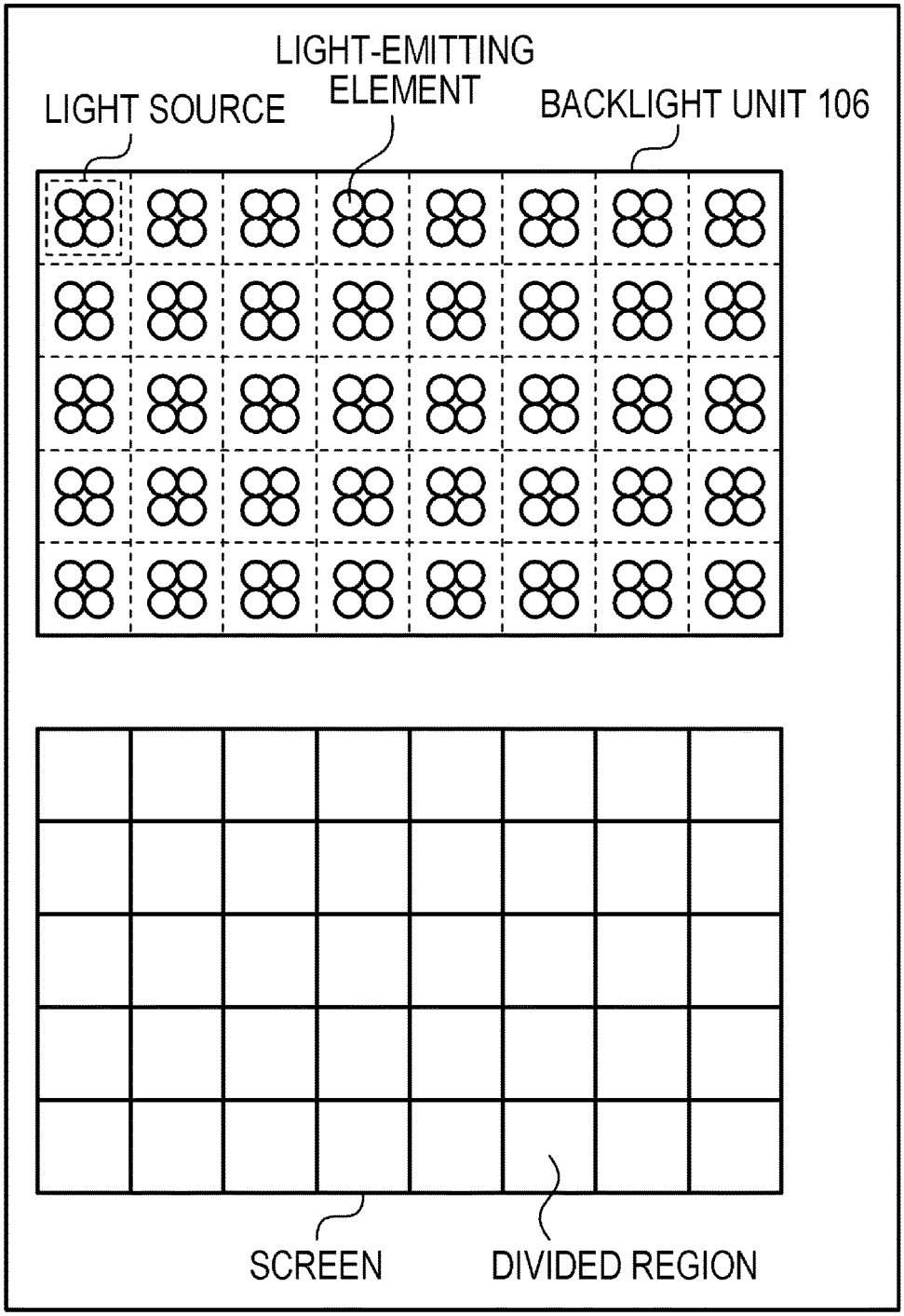
FIG. 3 is a diagram showing an example of a light source arrangement and screen regions according to the embodiment.

Specific methods of generating the BL control data will now be described. The backlight control unit 102 acquires the amount of characteristics in the display brightness data of screen regions corresponding to respective light sources. In this embodiment, as shown in FIG. 3, a plurality of light sources are arranged in a matrix, and, as a plurality of screen regions corresponding to the plurality of light sources, a plurality of divided regions that form the entire screen region are used. As the amount of characteristics, maximum values of display gradation values (maximum display gradation values) in the divided regions corresponding to the light sources are acquired. A maximum value of display brightness in each divided region (maximum display brightness) is achieved by inverse gamma correction of the acquired maximum display gradation value with a transmitted gamma value. The backlight control unit 102 then generates BL control data based on the maximum display brightness of each divided region so that the maximum display brightness is achieved in a case where the transmittance of the liquid crystal element is at its upper limit in each divided region. For example, the backlight control unit 102 generates BL control data such that light is projected to the liquid crystal element with the same brightness as the maximum display brightness in each divided region.

The method of controlling emission brightness of the backlight unit 106 (method of generating the BL control data) is not limited to a particular one. Various conventional techniques can be used as the method of generating BL control data. As the amount of characteristics, for example, an average value, mode value, minimum value, median, histogram, etc., of the display gradation value may be used. The BL control value of the light source may be determined based only on the amount of characteristics of that light source, or this may not necessarily be so. Sometimes, the light emitted from a light source may leak to screen regions corresponding to other light sources. In such a case, it is preferable to generate BL control data in consideration of the light leaking from the light sources. This way, more accurate BL control data can be generated.

While FIG. 3 illustrates a total of 40 light sources, in 5 lines and 8 columns, and a total of 40 divided regions, in 5 lines and 8 columns, the numbers of light sources and divided regions are not limited to this example. The number of light sources maybe larger than 40, or smaller than 40. The number of divided regions may be larger than 40, or smaller than 40. While one light source is formed by 4 light-emitting elements in FIG. 3, this may not necessarily be so. The number of light-emitting elements that belong to one light source may be larger, or smaller, than 4.

The arrangements of light sources, light-emitting elements, and screen regions are not limited in particular. For example, a plurality of light sources maybe arranged in a zigzag fashion. The plurality of screen regions corresponding to the plurality of light sources may not necessarily be a plurality of divided regions that form the entire screen region. A plurality of screen regions that are spaced away from each other may be used as the plurality of screen regions corresponding to the plurality of light sources. A screen region corresponding to a light source may, at least partly, be overlapping the screen regions corresponding to other light sources. A screen region corresponding to a light source may be the same as the screen region corresponding to another light source. The shape of the screen regions corresponding to the light sources is not limited in particular. For example, the shape of the screen regions corresponding to the light sources may be oval, circular, or polygonal (triangle, rectangle, pentagonal, hexagonal, etc.).

While one example has been described in this embodiment wherein the emission brightness of a plurality of light sources is controlled individually, this may not necessarily be so. The number of light source that belongs to the backlight unit 106 may be one. The emission brightness of a plurality of light sources may be controlled collectively. In other words, the emission brightness of a plurality of light sources may be controlled to be the same value. For example, an amount of characteristics of the entire display brightness data may be acquired, and the overall emission brightness of the backlight unit 106 may be controlled based on the acquired amount of characteristics.

Next, a specific method of generating BL brightness data will be described. "BL brightness" as herein used in this embodiment refers to the brightness of the light emitted from the backlight unit 106 to the liquid crystal element in a case where the backlight unit 106 emits light in accordance with the BL control data. The gradation value corresponding to the BL brightness will be referred to as "BL brightness gradation value". The BL brightness data contains the BL brightness gradation values of respective liquid crystal elements. The backlight control unit 102 calculates the BL brightness of each liquid crystal element in consideration of the distribution of the light emitted from respective light sources. The BL brightness dealt with in the image display apparatus 100 is not defined to be a specific value. In this embodiment, "1" is used as the BL brightness value with which a predetermined display brightness can be achieved in a case where the transmittance of the liquid crystal element is at its upper limit. The BL brightness values used here are values relative to the BL brightness value with which a predetermined display brightness can be achieved in a case where the transmittance of the liquid crystal element is at its upper limit. In this embodiment, a BL brightness gradation value with a bit depth of 10 is used. The bit depth of the BL brightness gradation value may be larger or smaller than 10.

The transmittance data conversion unit 103 corrects the display brightness data, based on the emission brightness of the backlight unit 106 (emission brightness of each light source), such as to reduce a change in the display brightness caused by a difference between the emission brightness of the backlight unit 106 and a predetermined standard brightness. This way, corrected image data is generated. More specifically, the transmittance data conversion unit 103 acquires the display brightness data output from the display brightness data conversion unit 101, and acquires the BL brightness data output from the backlight control unit 102. The transmittance data conversion unit 103 generates the corrected image data by correcting the display brightness data based on the BL brightness data. The transmittance data conversion unit 103 then outputs the corrected image data. The predetermined standard brightness is not limited in particular, but may be 1.0, for example.

In this embodiment, the gradation value of the corrected image data corresponds to the transmittance of the liquid crystal element. Therefore, the corrected image data may be referred to as "transmittance data". In this embodiment, the gradation values of the transmittance data are referred to as "transmittance gradation values". The transmittance dealt with in the image display apparatus 100 is not defined to be a specific value. In this embodiment, "1" is used as the upper limit of the transmittance. The transmittance values used here are values relative to the upper limit of the transmittance. The transmittance gradation value corresponds to the thus defined transmittance. The format of the transmittance data is not limited in particular. In this embodiment, the transmittance data is generated by the transmittance data conversion unit 103 through gamma correction of image data with the same transmitted gamma value as that used in a case of generating the display brightness data.

The transmittance for realizing a display brightness of B in a case where BL brightness is A can be determined by dividing the display brightness B by the BL brightness A. As mentioned above, the transmittance data in this embodiment is image data obtained by gamma correction with the same transmitted gamma value as that used in a case of generating the display brightness data. Therefore, the transmittance data conversion unit 103 generates the transmittance data by multiplying each display gradation value of the display brightness data by a gain value, which is a coefficient based on the BL brightness data (BL brightness gradation value). The gain value is calculated, for example, by the following equation 3. In this embodiment, a gain value is calculated for each of the liquid crystal elements. If the value obtained by multiplying the display gradation value by the gain value exceeds an upper limit (upper limit of transmittance gradation value), the upper limit is set as the transmittance gradation value (clipping process).

$$\text{Gain value}=(BL\text{ brightness gradation value}/1023)^{-\gamma t} \quad \text{(Equation 3)}$$

Figure 4:
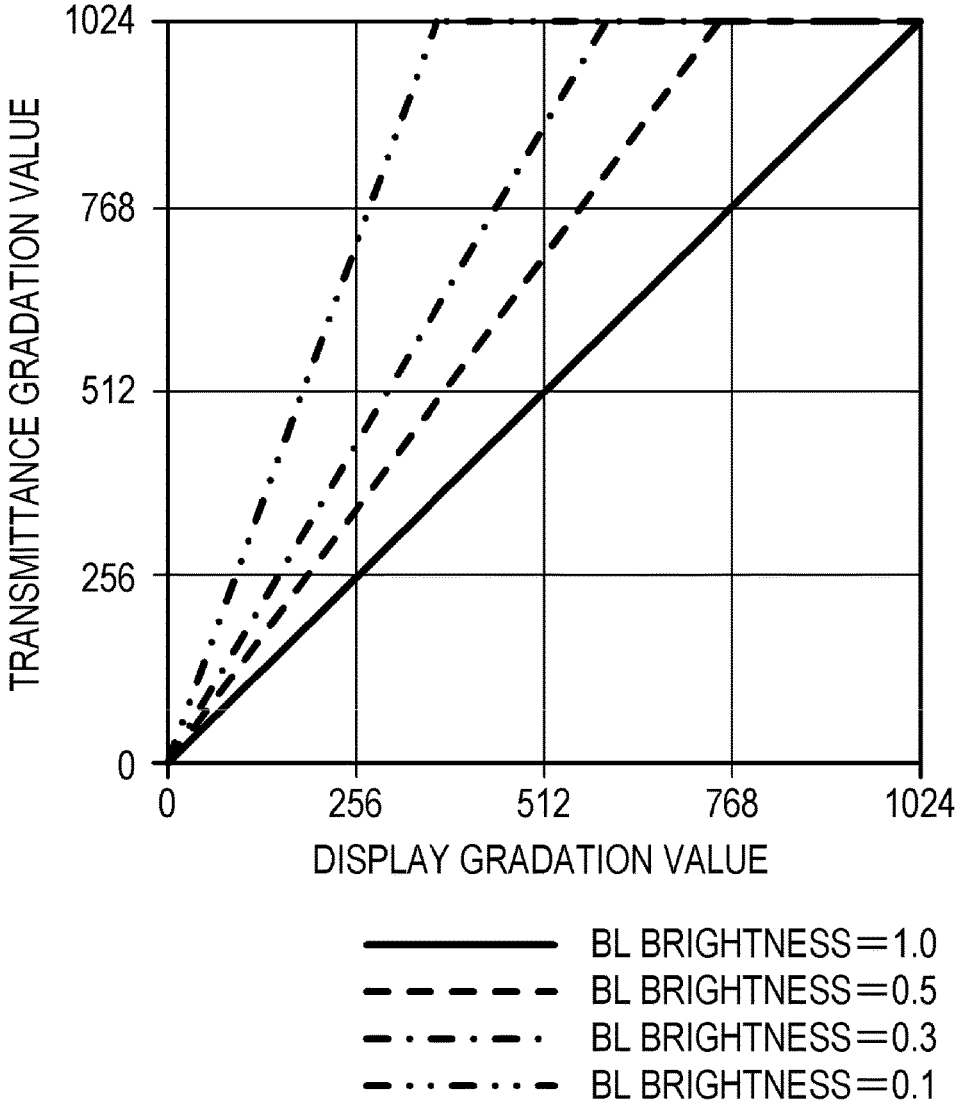
FIG. 4 is a chart showing an example of a relation between display gradation value and transmittance gradation value according to the embodiment.

FIG. 4 shows an example of relations between the BL brightness, display gradation value, and transmittance gradation value. FIG. 4 shows a correspondence between the display gradation value and the transmittance gradation value in a case where the BL brightness is 1.0, 0.5, 0.3, and 0.1. The lower the BL brightness, the higher the transmittance necessary for realizing the same display brightness as that in a case where the BL brightness is 1.0 (predetermined standard brightness). Therefore, the lower the BL brightness, the higher the transmittance gradation value, relative to the display gradation value, as shown in FIG. 4. In this embodiment, the display gradation value and the transmittance gradation value are both determined by gamma correction using a transmitted gamma value. Therefore, in a case where the BL brightness is 0.5, for example, the transmittance gradation value is 1.37 times ($=0.5^{-0.45}$) larger than the transmittance gradation value in a case where the BL brightness is 1.0.

The method of determining the transmittance gradation value is not limited to the one described above. For example, the same gain value maybe used for the plurality of liquid crystal elements in the screen regions corresponding to the light sources. Methods whereby the gain value is determined with the use of an LUT that outputs a gain value corresponding to the BL brightness gradation value are more preferable in terms of processing load than methods whereby the gain value is determined through calculation using mathematical equations. Such an LUT can be generated in advance by calculating gain values each corresponding to BL brightness gradation values in advance. Also, methods whereby display gradation values are converted into transmittance gradation values with the use of an LUT that outputs a transmittance gradation value corresponding to a combination of a display gradation value and a BL brightness gradation value are more preferable in terms of processing load than methods whereby display gradation values are converted into transmittance gradation values through calculation using mathematical equations. Such an LUT can be generated in advance by calculating transmittance gradation values each corresponding to the plurality of combinations of a display gradation value and a BL brightness gradation value.

The panel data conversion unit 104 acquires the transmittance data output from the transmittance data conversion unit 103, converts the transmittance data into panel data (second converted image data), and outputs the panel data. In this embodiment, the panel data conversion unit 104 converts transmittance gradation values of the transmittance data into panel gradation values based on a second correspondence, which is a correspondence relation between the transmittance gradation value and the panel gradation value, which is a gradation value input to the display panel. This way, panel data wherein each gradation value is a panel gradation value is generated. Generally, the characteristics of the liquid crystal elements of the liquid crystal panel 105 are different from ideal characteristics. Therefore, even though a transmittance gradation value is input to the liquid crystal elements, the transmittance of the liquid crystal element is not controlled to be one corresponding to the transmittance gradation value. In this embodiment, the transmittance gradation value is converted into a panel gradation value, so that a transmittance corresponding to the transmittance gradation value is realized. In this embodiment, a panel gradation value with a bit depth of 10 is used. The bit depth of the panel gradation value may be larger or smaller than 10.

The method of conversion into panel gradation values is not limited to the one described above. Methods whereby transmittance gradation values are converted into panel gradation values with the use of an LUT that outputs a panel gradation value corresponding to a transmittance gradation value are more preferable in terms of processing load than methods whereby transmittance gradation values are converted into panel gradation values through calculation using mathematical equations.

The method of determining the second correspondence is not limited to a particular one. However, the second correspondence (relation between the panel signal and the transmittance) is dependent on the characteristics of the liquid crystal panel 105 (liquid crystal elements). Therefore, the second correspondence is, preferably, a correspondence relation that is predetermined based on candidate values of panel gradation values (candidate gradation values) and measured values of the modulation factors used in a case where the liquid crystal panel 105 modulates the light from the backlight unit 106. The "modulation factors used in a case where the liquid crystal panel 105 modulates the light from the backlight unit 106" can be rephrased as the "transmittance in a case where the light from the backlight unit 106 passes through the liquid crystal panel 105".

For example, in a case where the backlight unit 106 is emitting light with a predetermined emission brightness, a plurality of display brightness values corresponding to the plurality of candidate gradation values may be measured with a luminance meter, or a plurality of displayed colors (colors on screen) corresponding to the plurality of candidate gradation values maybe measured with a colorimeter. A plurality of transmittances corresponding to the plurality of candidate gradation values are obtained based on the measurement results of the display brightness and displayed colors, so that the second correspondence is determined based on the plurality of transmittances corresponding to the plurality of candidate gradation values. In a case where the liquid crystal panel 105 includes a plurality of liquid crystal elements having different characteristics, the second correspondence should preferably be determined for each liquid crystal element individually. Preferably, then, one of the plurality of second correspondences should be selected for each liquid crystal element (second correspondence corresponding to the liquid crystal element), and the transmittance gradation values should be converted into panel gradation values based on the selected second correspondence.

Figure 5:
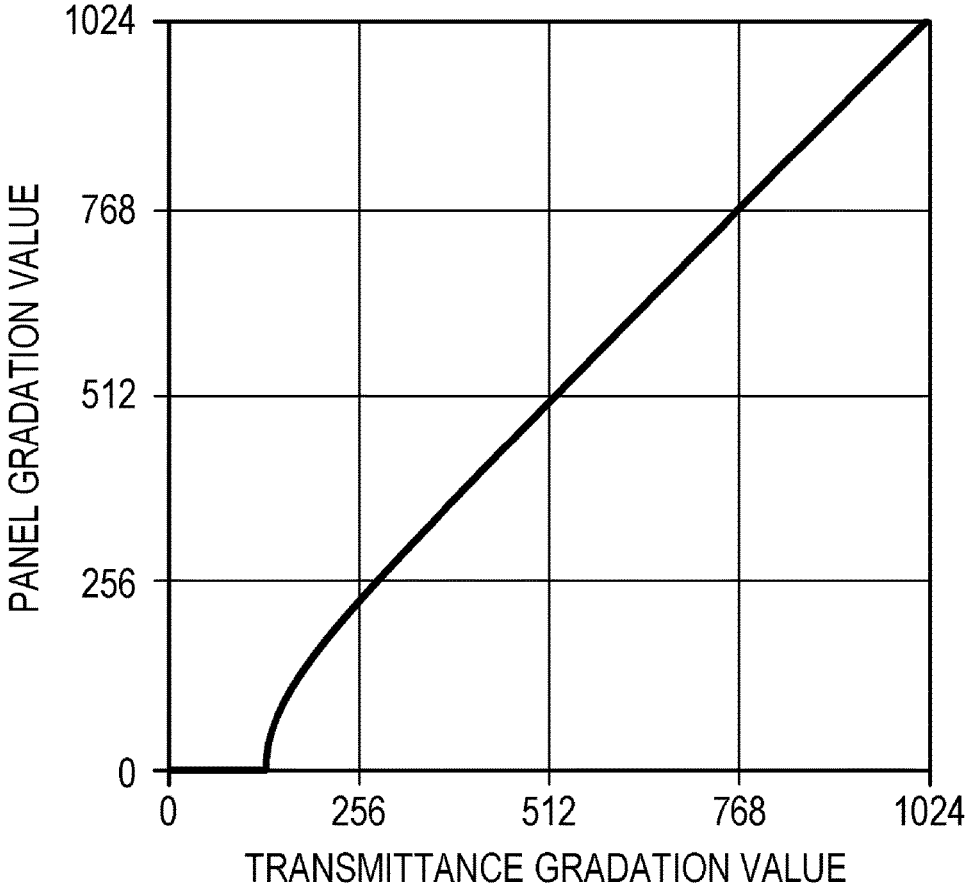
FIG. 5 is a chart showing an example of a second correspondence according to the embodiment.

FIG. 5 shows an example of a correspondence relation (second correspondence) between the transmittance gradation value and the panel gradation value. FIG. 5 shows an example in a case where the panel contrast ratio (upper limit of transmittance:lower limit of transmittance) is 100:1, and the relation between the panel gradation value and the transmittance is an ideal one, with the gamma value being 2.2. More specifically, FIG. 5 shows an example in which the relation between the panel gradation value and the transmittance is expressed by the following equation 4. If there is no panel gradation value corresponding to the transmittance gradation value of the transmittance data, the panel gradation value is set to zero (clipping process). Therefore, in this embodiment, the lower limit of the panel gradation value is corresponded to the range of the transmittance gradation value from its lower limit to a predetermined value in the second correspondence, as shown in FIG. 5.

$$\text{Transmittance}=(1/100)+(1-(1/100))\times(\text{panel gradation value}/1023)^{2.2} \quad \text{(Equation 4)}$$

Next, the operation of the image display apparatus 100, and the effects thereby achieved, will be described in more specific terms. For ease of understanding, two specific examples will be described.

(1) A case where the monitor contrast ratio equals to the panel contrast ratio

First, one example wherein the monitor contrast ratio equals to the panel contrast ratio will be described. More specifically, one example wherein both of the monitor contrast ratio and the panel contrast ratio are 100:1 will be described. In the example be low, the monitor gamma value is set to 2.2.

Figures 6A, 6B, 6C:
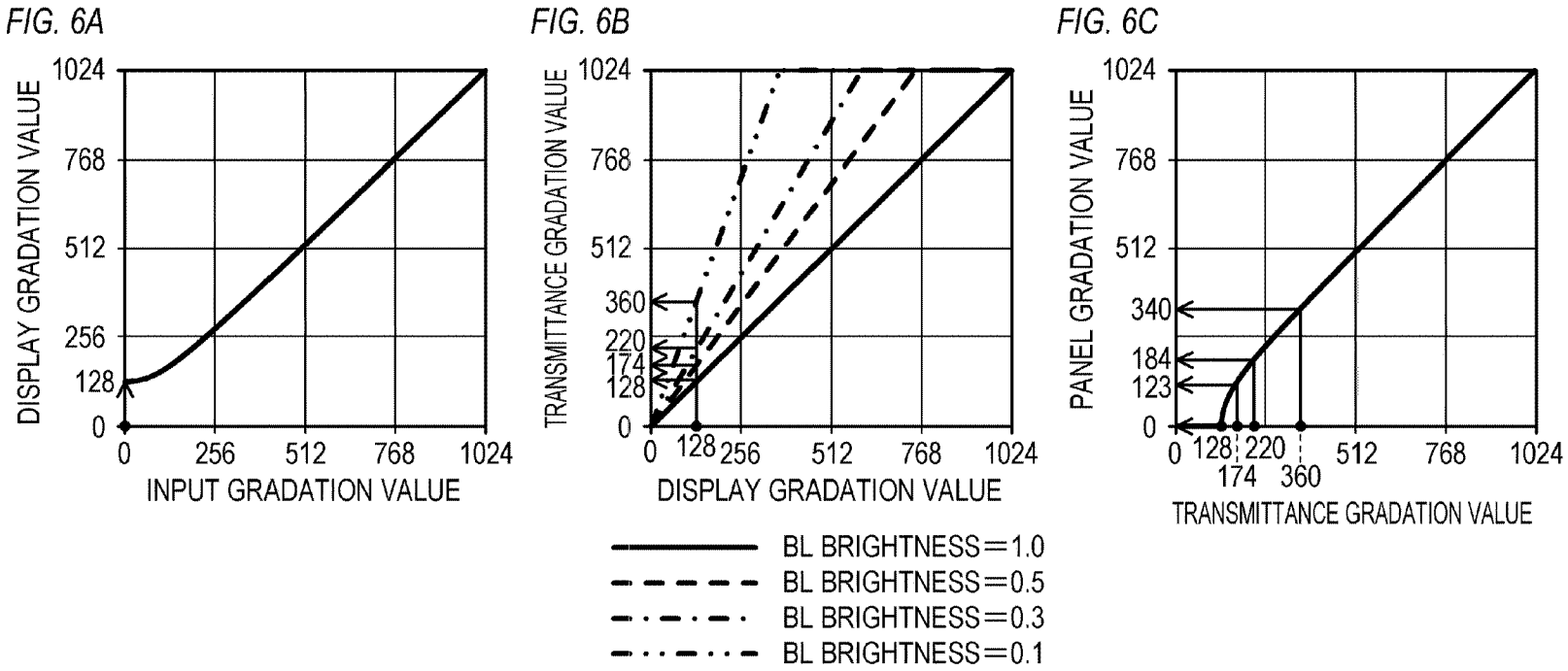
FIGS. 6A to 6C are charts showing an example of a process flow according to the embodiment.

FIG. 6A to FIG. 6C show the flow of the process for an input gradation value of 0 for black. FIG. 6A shows the process performed by the display brightness data conversion unit 101. As shown in FIG. 6A, the input gradation value 0 is converted into a display gradation value of 128 by the display brightness data conversion unit 101. FIG. 6B shows the process performed by the transmittance data conversion unit 103. As shown in FIG. 6B, the display gradation value 128 is converted into a transmittance gradation value corresponding to the BL brightness by the transmittance data conversion unit 103. More specifically, in a case where the BL brightness is 1.0, the display gradation value 128 is converted into a transmittance gradation value of 128, and in a case where the BL brightness is 0.5, the display gradation value 128 is converted into a transmittance gradation value of 174. In a case where the BL brightness is 0.3, the display gradation value 128 is converted into a transmittance gradation value of 220, and in a case where the BL brightness is 0.1, the display gradation value 128 is converted into a transmittance gradation value of 360. FIG. 6C shows the process performed by the panel data conversion unit 104. As shown in FIG. 6C, the transmittance gradation value 128 is converted into a panel gradation value of 0, while the transmittance gradation value 174 is converted into a panel gradation value of 123. The transmittance gradation value 220 is converted into a panel gradation value of 184, while the transmittance gradation value 360 is converted into a panel gradation value of 340.

In a case where a panel gradation value of 0 is input to the liquid crystal elements, the transmittance of the liquid crystal elements is 0.01. In a case where a panel gradation value of 123 is input to the liquid crystal elements, the transmittance of the liquid crystal elements is 0.02. In a case where a panel gradation value of 184 is input to the liquid crystal elements, the transmittance of the liquid crystal elements is 0.03. In a case where a panel gradation value of 340 is input to the liquid crystal elements, the transmittance of the liquid crystal elements is 0.10. Therefore, black is displayed with the display brightness of 0.01 irrespective of the BL brightness, and the image is displayed with the same contrast ratio as the monitor contrast ratio irrespective of the BL brightness. The display brightness can be determined by multiplying the transmittance by the BL brightness. In this embodiment, panel gradation values that are larger than the input gradation values are used, so that black non-uniformity (unevenness in the transmittance of the liquid crystal panel) is reduced.

As described above, according to this embodiment, input image data is converted into display brightness data, and the BL brightness is controlled based on the display brightness data. More specifically, the BL brightness is reduced from the standard value based on the display brightness data. The display brightness data is then converted into transmittance data, which is converted into panel data, and the transmittance is controlled based on the panel data. This way, black non-uniformity (black unevenness) can be reduced while the contrast of a displayed image (image displayed on the screen) is maintained. In this embodiment, the reciprocal of BL brightness is referred to as "reduction rate of BL brightness". In a case where the BL brightness is ½, the reduction rate is 2, and in a case where the BL brightness is ⅓, the reduction rate is 3.

Figure 7:
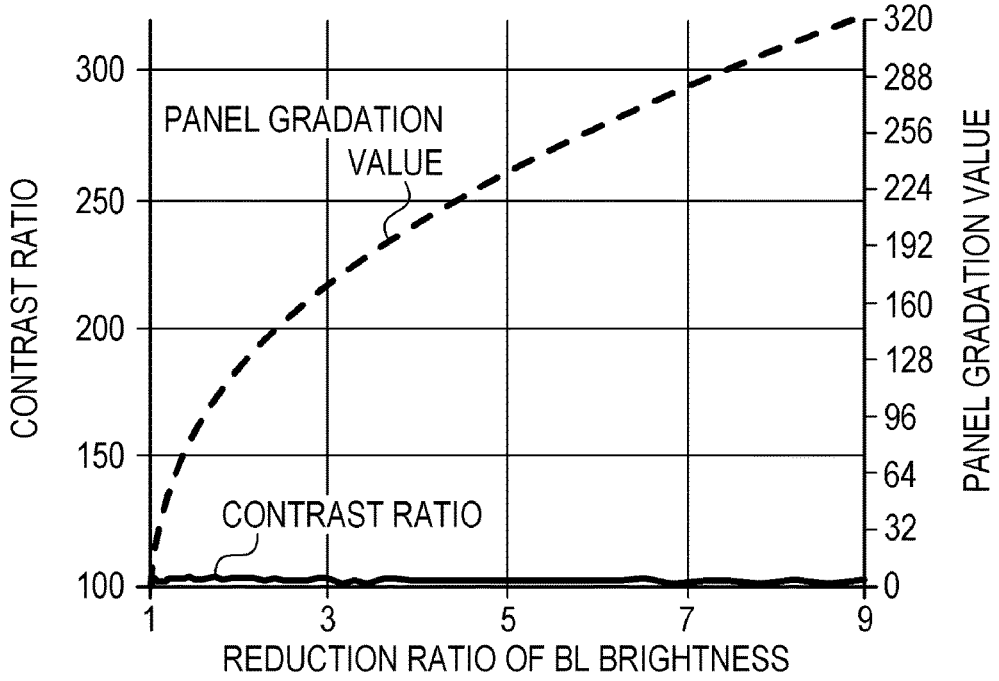
FIG. 7 is a chart showing an example of advantageous effects according to the embodiment.

FIG. 7 shows an example of correspondence relations between the reduction rate of BL brightness, actual contrast ratio of display brightness, and panel gradation value corresponding to black. The BL brightness is the reciprocal of the reduction rate. As shown in FIG. 7, in this embodiment, the panel gradation value increases with the reduction in the BL brightness (increase of reduction rate), while the actual contrast ratio of display brightness is maintained. With the increasing panel gradation value, black non-uniformity is reduced.

Figure 8:
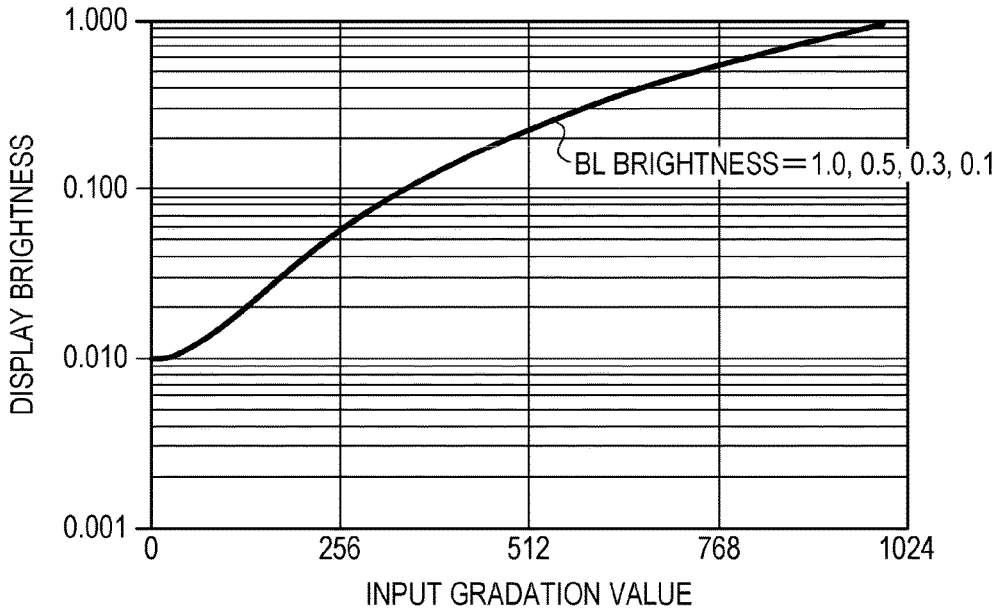
FIG. 8 is a chart showing an example of advantageous effects according to the embodiment.

FIG. 8 shows an example of correspondence relations between the BL brightness, input gradation value, and actual display brightness. As shown in FIG. 8, in this embodiment, the correspondence between the input gradation value and the actual display brightness is not dependent on the BL brightness. Therefore, according to this embodiment, the contrast of the displayed image is maintained.

(2) A case where the monitor contrast ratio is higher than the panel contrast ratio Next, one example wherein the monitor contrast ratio is higher than the panel contrast ratio will be described. More specifically, one example wherein the panel contrast ratio is 100:1, while the monitor contrast ratio is 300:1 will be described. In the example below, the monitor gamma value is set to 2.2.

Figures 9A, 9B, 9C:
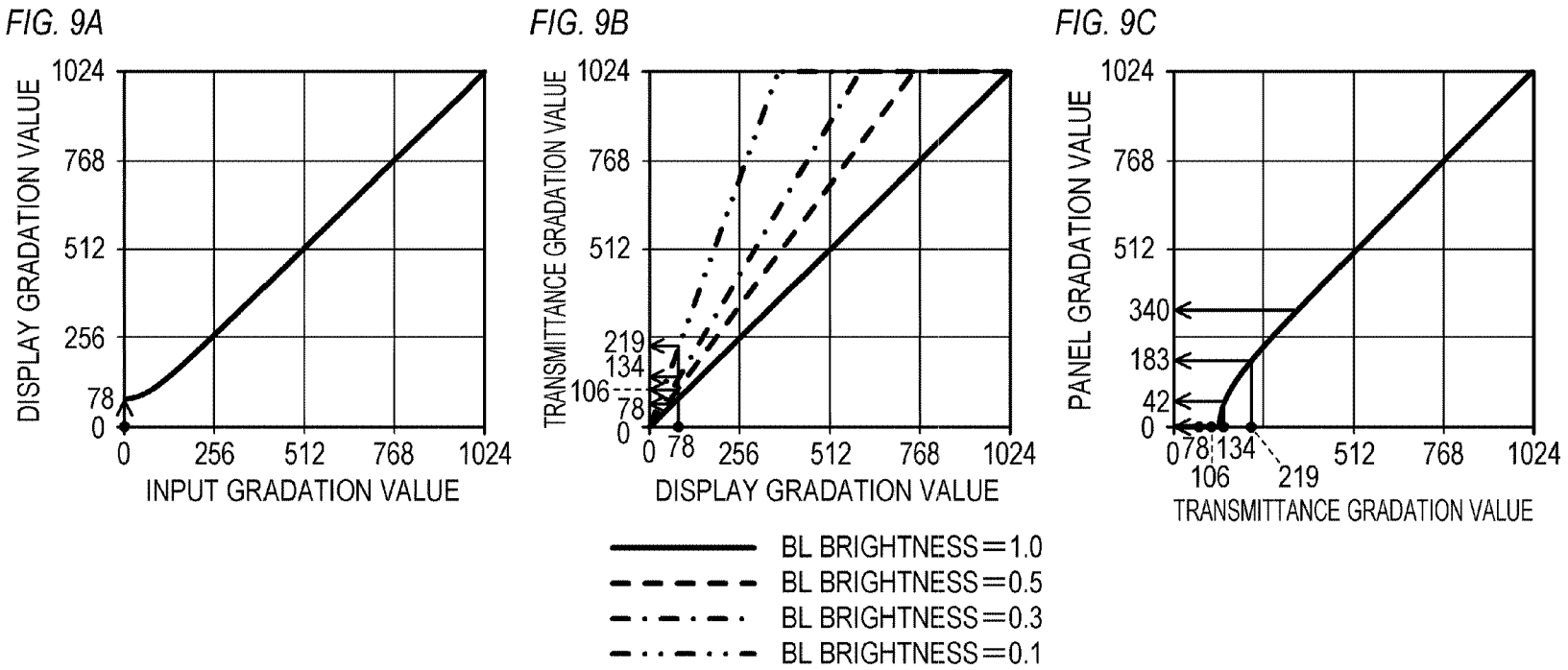
FIGS. 9A to 9C are charts showing an example of a process flow according to the embodiment.

FIG. 9A to FIG. 9C show the flow of the process for an input gradation value of 0 for black. FIG. 9A shows the process performed by the display brightness data conversion unit 101. As shown in FIG. 9A, the input gradation value 0 is converted into a display gradation value of 78 by the display brightness data conversion unit 101. FIG. 9B shows the process performed by the transmittance data conversion unit 103. As shown in FIG. 9B, the display gradation value 78 is converted into a transmittance gradation value corresponding to the BL brightness by the transmittance data conversion unit 103. More specifically, in a case where the BL brightness is 1.0, the display gradation value 78 is converted into a transmittance gradation value of 78, and in a case where the BL brightness is 0.5, the display gradation value 78 is converted into a transmittance gradation value of 106. In a case where the BL brightness is 0.3, the display gradation value 78 is converted into a transmittance gradation value of 134, and in a case where the BL brightness is 0.1, the display gradation value 78 is converted into a transmittance gradation value of 219. FIG. 9C shows the process performed by the panel data conversion unit 104. As shown in FIG. 9C, the transmittance gradation value 78 is converted into a panel gradation value of 0, and the transmittance gradation value 106 is also converted into a panel gradation value of 0. The transmittance gradation value 134 is converted into a panel gradation value of 42, while the transmittance gradation value 219 is converted into a panel gradation value of 183.

In a case where a panel gradation value of 0 is input to the liquid crystal elements, the transmittance of the liquid crystal elements is 0.01. Therefore, in a case where the BL brightness is 1.0, black is displayed with a display brightness of 0.01, and the image is displayed with a contrast ratio of 100:1 which is lower than the monitor contrast ratio. In a case where the BL brightness is 0.5, black is displayed with a display brightness of 0.005, and the image is displayed with a contrast ratio of 200:1 which is lower than the monitor contrast ratio. This reduction in contrast is caused by insufficient reduction of BL brightness. More specifically, in a case where reduction of BL brightness is insufficient, the panel signal of black is clipped to zero in order to maximize the actual contrast of the displayed image. This causes the reduction in contrast mentioned above.

In a case where a panel gradation value of 42 is input to the liquid crystal elements, the transmittance of the liquid crystal elements is 0.01. In a case where a panel gradation value of 183 is input to the liquid crystal elements, the transmittance of the liquid crystal elements is 0.03. Therefore, in a case where the BL brightness is 0.3, black is displayed with a display brightness of 0.003, and the image is displayed with a contrast ratio of 300:1, which is the same as the monitor contrast ratio. In a case where the BL brightness is 0.1, black is displayed with a display brightness of 0.003, too, and the image is displayed with a contrast ratio of 300:1, which is the same as the monitor contrast ratio. This way, according to this embodiment, in a case where reduction of BL brightness is sufficient, the image is displayed with the same contrast ratio as the monitor contrast ratio irrespective of the BL brightness. According to this embodiment, panel gradation values that are larger than the input gradation values are used in a case where reduction of BL brightness is sufficient, so that black non-uniformity is reduced.

Figure 10:
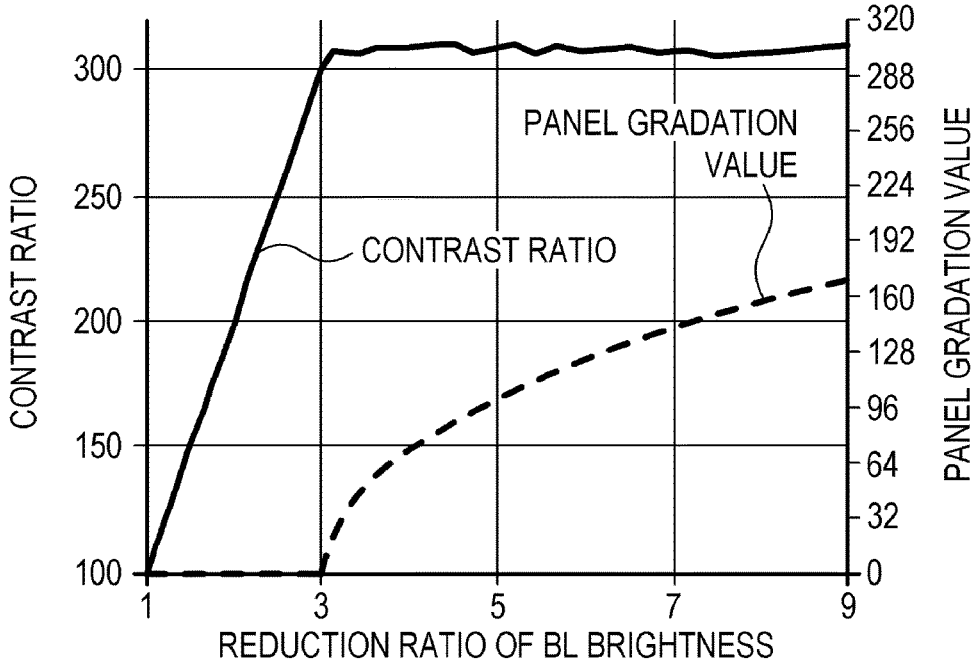
FIG. 10 is a chart showing an example of advantageous effects according to the embodiment.

FIG. 10 shows an example of correspondence relations between the reduction rate of BL brightness, actual contrast ratio of display brightness, and panel gradation value corresponding to black. As shown in FIG. 10, in this embodiment, the actual contrast ratio of display brightness increases to as high as the monitor contrast ratio with the reduction in the BL brightness (increase of reduction rate). The panel gradation value increases with the reduction in the BL brightness within the range of BL brightness where the actual contrast ratio of display brightness matches the monitor contrast. With the increasing panel gradation value, black non-uniformity is reduced. In the example of FIG. 10, as the reduction rate increases from 1 to 3, the actual contrast ratio of display brightness increases from 100:1 to 300:1. In a case where the reduction rate is 3 or higher, the actual contrast ratio of display brightness of 300:1 is achieved irrespective of the reduction rate. In a case where the reduction rate is 3 or higher, the panel gradation value increases with the increase in the reduction rate.

Figure 11:
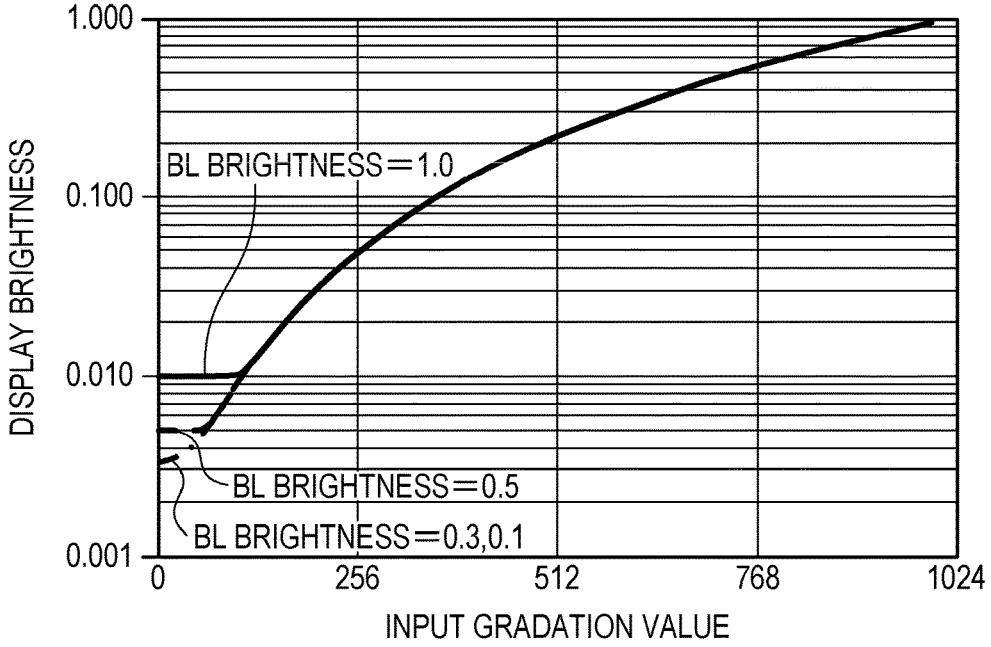
FIG. 11 is a chart showing an example of advantageous effects according to the embodiment.

FIG. 11 shows an example of correspondence relations between the BL brightness, input gradation value, and actual display brightness. As shown in FIG. 11, the correspondence between the input gradation value and the actual display brightness is not dependent on the BL brightness within the range of display brightness of more than 0.01 for black corresponding to the panel contrast. The correspondence between the input gradation value and the actual display brightness is dependent on the BL brightness within the range of display brightness of less than the value for black corresponding to the panel contrast. More specifically, the lower limit of the actual display brightness is determined in accordance with the BL brightness.

As can be seen from the two specific examples described above, the display brightness data is generated in consideration of the monitor contrast in this embodiment. The emission brightness of the backlight unit 106 is reduced, as well as the gradation value is increased in order to compensate for the reduction in the display brightness caused by the reduction in the emission brightness. This way, the actual contrast of the displayed image is increased to the same value as the monitor contrast, so that black non-uniformity is reduced. In this embodiment, no processing is performed with the use of a special gradation value for black. Therefore, unless the panel contrast poses limitations on the upper and lower limits of actual display brightness, the gradation characteristic of the actual display brightness (correspondence between the input gradation value and the actual display brightness) is not dependent on the emission brightness of the backlight unit 106, and there occurs no distortion in the gradation characteristic of the actual display brightness.

In order to reduce black non-uniformity while maintaining the contrast of a displayed image, it is preferable to have a high reduction rate of BL brightness. However, a large temporal change in the BL brightness may cause problems such as flickering. To avoid occurrence of such a problem, it is preferable to limit the reduction rate of BL brightness within a predetermined allowable range. The lower limit of the emission brightness of the backlight unit 106 may sometimes be limited by electrical or thermal or other factors. In this case, the reduction rate should preferably be determined such that the emission brightness of the backlight unit 106 does not become less than the lower limit.

This embodiment has been described with a focus only on brightness. However, the processing described above may be performed to each of a plurality of color components. For example, if pixels of input image data have RGB values (combinations of R, G, and B values), each of the R, G, and B values may be converted with the method described above. R value is the gradation value corresponding to red, G value is the gradation value corresponding to green, and B value is the gradation value corresponding to blue.

Sometimes, the chromaticity on the screen in a case where the transmittance of the liquid crystal panel 105 is controlled to be its upper limit (white chromaticity) may differ from the chromaticity on the screen in a case where the transmittance of the liquid crystal panel 105 is controlled to be its lower limit (black chromaticity). In this case, the panel contrast ratios respectively corresponding to red, green, and blue may be used individually to determine a plurality of second correspondences.

For example, with the use of a panel contrast ratio of 200:1 corresponding to red, a correspondence relation (second correspondence) may be determined between the transmittance gradation value obtained from the R value and the panel gradation value input to the liquid crystal element that displays red. With the use of a panel contrast ratio of 100:1 corresponding to green, a correspondence relation (second correspondence) maybe determined between the transmittance gradation value obtained from the G value and the panel gradation value input to the liquid crystal element that displays green. With the use of a panel contrast ratio of 50:1 corresponding to blue, a correspondence relation (second correspondence) may be determined between the transmittance gradation value obtained from the B value and the panel gradation value input to the liquid crystal element that displays blue. These panel contrast ratios are determined such that the total of the lower limits of the display brightness for red, green, and blue matches the display brightness for black (display brightness in a case where the transmittance of the liquid crystal panel 105 is controlled to be its lower limit).

In a case where the white chromaticity differs from the black chromaticity, and in a case where a plurality of panel contrast ratios corresponding to a plurality of color components are used, the second correspondence differs from one to another of the plurality of color components. In a case where it is desired to reduce black non-uniformity so as to maintain the black chromaticity, a plurality of panel contrast ratios corresponding to a plurality of color components may be set. More specifically, a plurality of panel contrast ratios corresponding to a plurality of color components may be set such that the ratio between a plurality of monitor contrast ratios corresponding to color components matches the ratio between the plurality of panel contrast ratios corresponding to color components.

At least one of the display brightness data conversion unit 101, backlight control unit 102, transmittance data conversion unit 103, and panel data conversion unit 104 may be provided in an external device of the image display apparatus 100. For example, the display brightness data conversion unit 101 maybe provided in the external device. More specifically, the display brightness data conversion unit 101 may be provided in a data conversion device such as a color grading device. In this case, the monitor contrast ratio and the monitor gamma value may be set in the external device. In conventional color grading, while data adjustment for reducing the contrast was possible, data adjustment for enhancing the contrast was not possible. The processing described above according to this embodiment enables data adjustment for enhancing the contrast. Moreover, the processing facilitates changes in data adjustment in accordance with the contents or scenes of the image data.

Figure 12:
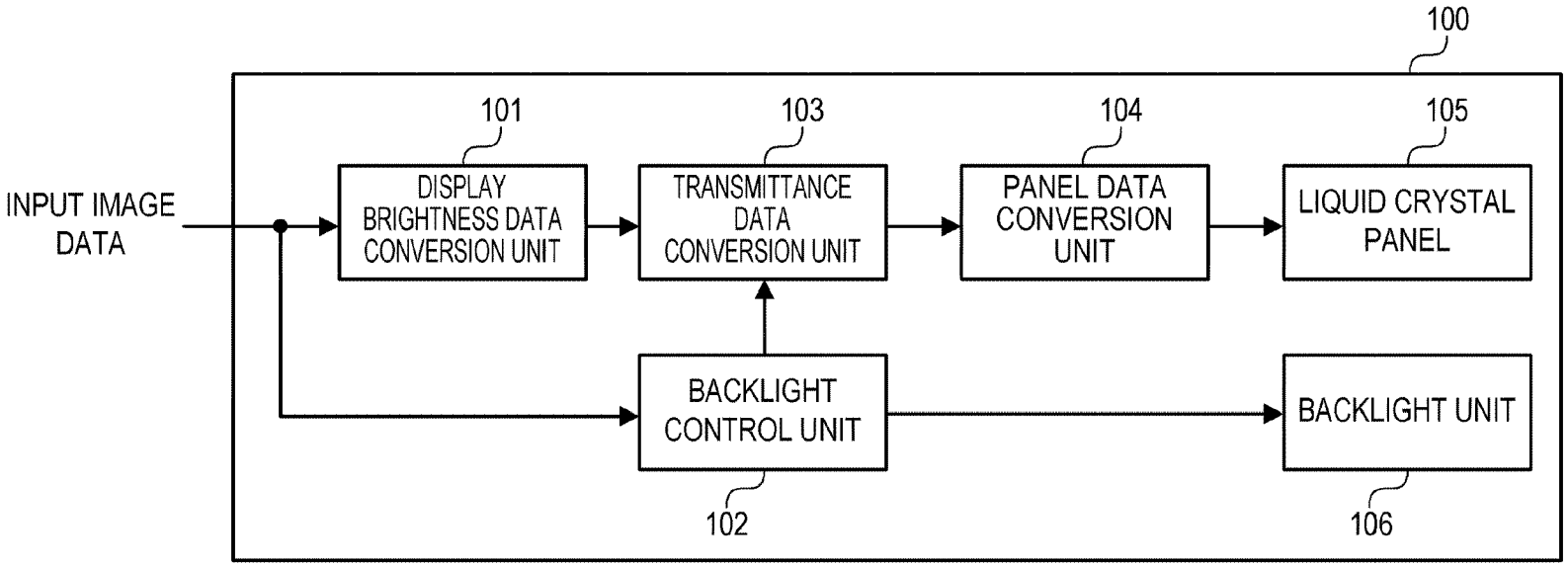
FIG. 12 is a block diagram illustrating an example of the functional configuration of another image display apparatus according to the embodiment.

While one example has been described in this embodiment wherein the emission brightness of the backlight unit 106 is controlled based on the display brightness data, this may not necessarily be so. For example, the emission brightness of the backlight unit 106 may be controlled based on the input image data. FIG. 12 shows one example of the functional configuration of another image display apparatus 200 according to this embodiment. In the configuration of FIG. 12, the backlight control unit 102 acquires input image data, generates BL control data and BL brightness data based on the input image data, and outputs the BL control data and BL brightness data. The processing performed in other function units shown in FIG. 12 is the same as that described with reference to FIG. 1.

In order to enhance the contrast of the displayed image and to reduce black non-uniformity, it is preferable to control the emission brightness of the backlight unit 106 based on the display brightness data. However, sometimes, the gradation value for black may be used as a special value in determining the emission brightness of the backlight unit 106. In this case, since the display gradation value for black changes in accordance with the monitor contrast ratio, the preset value used for detection of the gradation value for black (input gradation value) needs to be changed. Therefore, in a case where the emission brightness is determined by a method that uses a special gradation value for black, it is preferable to input the input image data to the backlight control unit 102, and to determine the emission brightness based on the input image data. Since the input gradation value is not dependent on the monitor contrast ratio, the preset value to be used for detection of the gradation value for black (input gradation value) need not be changed, so that the processing load is reduced.

<Other Embodiments>

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-136943, filed on Jul. 8, 2015, which is hereby incorporated by reference herein in its entirety.

What is claimed is:

1. An image display apparatus comprising:

a light-emitting unit includes a plurality of light sources of which the emission brightness are individually controllable;

a display unit configured to display an image by transmitting light emitted from the plurality of light sources; and a controller configured to control an emission brightness of each of the plurality of light sources, and control transmittance of the display unit, wherein the controller:

generates first image data by increasing a lower limit of gradation values of input image data to a first gradation value;

controls an emission brightness of each light source based on brightness of each region of the input image data or the first image data corresponding to each of the plurality of light sources;

generates second image data by correcting gradation values of the first image data based on the emission brightness of each light source;

generates third image data by reducing gradation values of the second image data that are equal to or lower than a second gradation value to a predetermined value; and controls the display unit to display the image by controlling the transmittance of the display unit based on the third image data, and wherein in a case where emission brightness of a light source corresponding to a region of the first image data is first brightness, the controller generates the second image data so that gradation values of the second image data in the region is smaller than in a case where the emission brightness of the light source corresponding to the region is second brightness which is lower than the first brightness.

2. The image display apparatus according to claim 1, wherein the controller generates the first image data such that gradation value of the first image data increases non-linearly with an increase in gradation value of the input image data.

3. The image display apparatus a cording to claim 1, wherein the controller generates the second image data by multiplying each of the gradation values of the first image data by a coefficient obtained based on the emission brightness of the light-emitting unit.

4. The image display apparatus according to claim 1, wherein the controller generates the first image data based on at least one of a contrast ratio related to display characteristics of the image display apparatus, and a gamma value set for the image display apparatus.

5. The image display apparatus according to claim 1, wherein the controller generates the third image data such that gradation value of the third image data increases non-linearly with an increase in gradation value of the second image data.

6. The image display apparatus according to claim 1, wherein the controller converts the gradation values of the second image data that are equal to or lower than the second gradation value to zero.

7. A control method for an image display apparatus including a light-emitting unit and a display unit, wherein the light-emitting unit includes a plurality of light sources of which the emission brightness are individually controllable;

the display unit displays an image by transmitting light emitted from the plurality of light sources, the control method includes:

a first conversion step of generating first image data by increasing a lower limit of gradation values of input image data to a first gradation value;

a control step of controlling an emission brightness of each light source based on brightness of each region of the input image data or the first image data corresponding to each of the plurality of light sources;

a second conversion step of generating second image data by correcting gradation values of the first image data based on the emission brightness of each light source;

a third conversion step of generating third image data by reducing gradation values of the second image data that are equal to or lower than a second gradation value to a predetermined value; and a display control step of controlling the display unit to display the image by controlling the transmittance of the display unit based on the third image data, and wherein in a case where emission brightness of a light source corresponding to a region of the first image data is first brightness, in the second conversion step, the second image data is generated so that gradation values of the second image data in the region is smaller than in a case where the emission brightness of the light source corresponding to the region is second brightness which is lower than the first brightness.

8. The control method according to claim 7, wherein in the first conversion step, the first image data is generated such that gradation value of the first image data increases non-linearly with an increase in gradation value of the input image data.

9. The control method according to claim 7, wherein in the second conversion step, the second image data is generated by multiplying each of the gradation values of the first image data by a coefficient obtained based on the emission brightness of the light-emitting unit.

10. The control method according to claim 7, wherein in the first conversion step, the first image data is generated based on at least one of a contrast ratio related to display characteristics of the image display apparatus, and a gamma value set for the image display apparatus.

11. The control method according to claim 7, wherein in the third conversion step, the third image data is generated such that gradation value of the third image data increases non-linearly with an increase in gradation value of the second image data.

12. The control method according to claim 7, wherein in the third conversion step, the gradation values of the second image data that are equal to or lower than the second gradation value are converted to zero.

13. A non-transitory computer readable medium that, stores a program, wherein the program causes a computer to execute a control method for an image display apparatus including a light-emitting unit and a display unit, the light-emitting unit includes a plurality of light sources of which the emission brightness are individually controllable;

the display unit displays an image by transmitting light emitted from the plurality of light sources, the control method include:

a first conversion step of generating first image data by increasing a lower limit of gradation values of input image data to a first gradation value;

a control step of controlling an emission brightness of each light source based on brightness of each region of the input image data or the first image data corresponding to each of the plurality of light sources;

a second conversion step of generating second image data by correcting gradation values of the first image data based on the emission brightness of each light source;

a third conversion step of generating third image data by reducing gradation values of the second image data that are equal to or lower than a second gradation value to a predetermined value; and a display control step of controlling the display unit to display the image by controlling the transmittance of the display unit based on the third image data, and wherein in a case where emission brightness of a light source corresponding to a region of the first image data is first brightness, in the second conversion step, the second image data is generated so that gradation values of the second image data in the region is smaller than in a case where the emission brightness of the light source corresponding to the region is second brightness which is lower than the first brightness.

* * * * *